US005542196A

United States Patent [19]

Kantro

[11] Patent Number: 5,542,196

[45] Date of Patent: Aug. 6, 1996

[54] INSOLE

[75] Inventor: Scott Kantro, New York, N.Y.

[73] Assignee: Donna Karan Shoe Company, New York, N.Y.

[21] Appl. No.: 459,536

[22] Filed: Jun. 2, 1995

Related U.S. Application Data

[63] Continuation of Ser. No. 228,131, Apr. 15, 1994, abandoned.

[51] Int. Cl.[6] ..... A43B 13/38

[52] U.S. Cl. ..... 36/44; 36/30 R; 36/174; 36/181; 36/80

[58] Field of Search ..... 36/30 R, 44, 43, 36/80, 180, 181, 182, 174, 176, 178, 30 A

[56] References Cited

U.S. PATENT DOCUMENTS

| | | | |
|---|---|---|---|
| D. 204,596 | 5/1966 | Anson . | |
| D. 266,371 | 10/1982 | Stubblefield . | |
| D. 266,798 | 11/1982 | Famolare, Jr. . | |
| D. 267,288 | 12/1982 | Davis . | |
| D. 267,366 | 12/1982 | Davis . | |
| D. 269,139 | 5/1983 | Stubblefield . | |
| 301,226 | 7/1884 | Gardner . | |
| 363,946 | 5/1887 | Bradfor . | |
| 492,994 | 3/1893 | Sawyer . | |
| 1,111,437 | 9/1914 | Butterfield . | |
| 1,281,987 | 10/1918 | McSweeney | 36/176 |
| 1,498,566 | 6/1924 | Noble | 36/176 |
| 1,710,936 | 4/1929 | May . | |
| 1,746,002 | 2/1930 | Lobel | 36/180 |
| 2,161,565 | 6/1939 | Freda . | |
| 2,251,468 | 8/1941 | Smith . | |
| 2,383,583 | 8/1945 | Becker . | |
| 2,413,534 | 12/1946 | Watson | 36/181 |
| 2,424,463 | 7/1947 | Hogg . | |
| 2,713,214 | 7/1955 | Gulaskie | 36/44 |
| 2,784,502 | 3/1957 | Morali | 36/44 |
| 2,863,231 | 12/1958 | Jones | 36/174 |
| 2,909,854 | 10/1959 | Edelstein . | |
| 2,928,193 | 3/1960 | Kristan | 36/178 |
| 2,959,875 | 11/1960 | Frese, Jr. | 36/180 X |
| 3,099,267 | 7/1963 | Cherniak | 36/174 |
| 3,114,981 | 12/1963 | Murawski . | |
| 3,233,348 | 2/1966 | Gilkerson . | |
| 4,316,332 | 2/1982 | Giese et al. | 36/30 R X |
| 4,335,530 | 6/1982 | Stubblefield . | |
| 4,372,058 | 2/1983 | Stubblefield . | |
| 4,494,320 | 1/1985 | Davis . | |
| 4,513,518 | 4/1985 | Jalbert et al. . | |
| 4,541,184 | 9/1985 | Leighton . | |

(List continued on next page.)

FOREIGN PATENT DOCUMENTS

| | | | |
|---|---|---|---|
| 0125166 | 8/1947 | Australia | 36/178 |
| 2709546 | 9/1978 | Germany . | |
| 0303241 | 5/1937 | Italy | 36/80 |

*Primary Examiner*—Paul T. Sewell
*Assistant Examiner*—Ted Kavanaugh
*Attorney, Agent, or Firm*—Curtis, Morris & Safford, P.C.

[57] ABSTRACT

An innersole for use in a shoe or the like and generally having a shoe-shape said innersole comprising a first region having a first hardness, said first region designed to underlie the periphery of the rearfoot, the centroid region of the foot and the periphery of the forefoot, and, a second region having a second hardness, said second region designed to underlie the calcaneal region and the metatarsal or transverse arch, wherein the first region is about 5 to about 15 Shore A durometer harder than the second region. The first region is preferably a second layer and the second region is preferably a first layer. The first layer is generally shoe-shaped and has a first hardness. The second layer has a second hardness and is designed to underlie the periphery of the forefoot, the periphery of the rearfoot, and the centroid region of the foot and said second layer having means defining a first opening designed to underlie the calcaneal region and means defining a second opening designed to underlie the metatarsal or transverse arch. The second hardness is greater than the first hardness and the second layer is positioned beneath the first layer or is embedded therein so as to be substantially integral a lower surface of the first layer. A shoe and method employing the insole are also encompassed by the invention.

11 Claims, 6 Drawing Sheets

U.S. PATENT DOCUMENTS 4,557,060 12/1985 Kawashima ..... 36/30 R X
4,627,177 12/1986 Meyers .
4,674,204 6/1987 Sullivan ..... 36/44
4,694,589 9/1987 Sullivan et al. .
4,791,736 12/1988 Phillips .
4,794,707 1/1989 Franklin et al. ..... 36/30 R X
4,908,961 3/1990 Purslow et al. .
4,910,886 5/1990 Sullivan et al. .
4,930,232 6/1990 Engle ..... 36/80 X
4,931,773 6/1990 Rosen .
4,932,141 6/1990 Hones .
4,955,148 9/1990 Padilla .
5,010,661 4/1991 Chu .
5,014,706 5/1991 Philipp .
5,068,983 12/1991 Gilkerson .
5,077,915 1/1992 Gross ..... 36/28 X
5,138,774 8/1992 Sarkozi .
5,146,698 9/1992 Tilles et al. .
5,170,572 12/1992 Kantro ..... 36/174 X
5,189,816 3/1993 Shibata .
5,282,326 2/1994 Schroer, Jr. et al. .

FIG. 3A
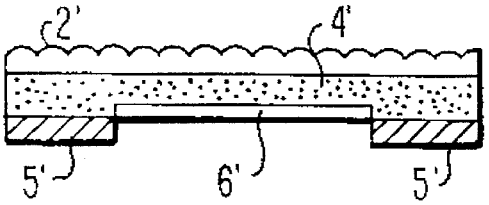
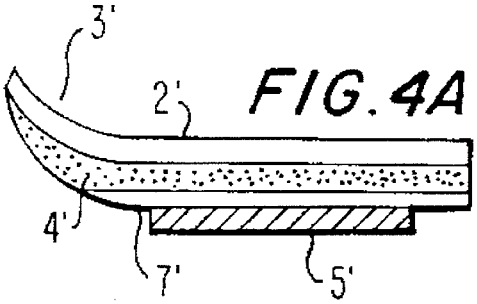
FIG. 4A
FIG. 5A
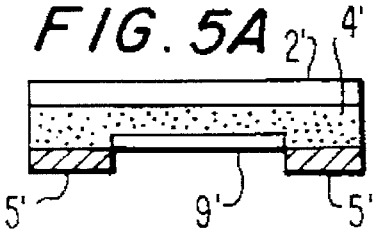
FIG. 6A
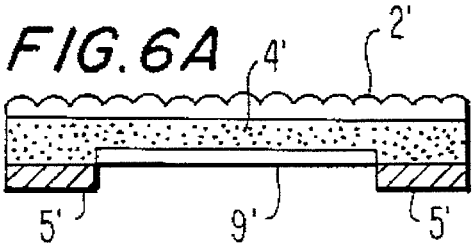
FIG. 7A
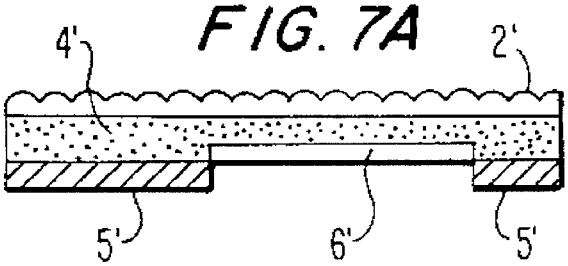

INSOLE

This application is a continuation of application Ser. No. 08/228,131, filed Apr. 15, 1994 now abandoned.

FIELD OF THE INVENTION

This invention relates to an innersole and/or midsole component of an article of footwear. Documents cited in the following text are hereby incorporated herein by reference.

BACKGROUND OF THE INVENTION

The environment within which a human ambulates—footwear—can have negative effects on the musculoskeletal structures of the body. Examples of these negative effects range from stress/strain syndromes of the lower extremities, including the feet, to chronic reoccurrence of severe headaches. Past efforts to reduce these negative effects have failed to enhance the primary functions of the human foot. These functions are: (1) support, (2) cushioning, and (3) guidance. The failure to address any of these three functions is a primary cause of gait related injury, either impact related or torsional related.

Prior efforts to reduce the negative effects of footwear have failed to address the three primary areas of the foot, which in turn has led to a failure to enhance the three primary functions of the foot. The three primary areas of the foot are the calcaneus, or rear foot region; the midfoot region or tarsus region; and the forefoot or metatarsal head region.

The rear foot region is responsible for cushioning and for stabilization or stability upon heel strike. The midfoot region functions to further enhance cushioning, but more obviously provides stability and guidance. The forefoot region is primarily involved in guidance for push off, and also in cushioning.

It would therefore be useful to provide an innersole/midsole which enhances the three primary roles of the foot by enhancing the functions that occur at the three primary foot regions. In this regard, mention is made of Purslow et al., U.S. Pat. No. 4,908,961 in that "insole" or "innersole" is used in this disclosure with respect to the present invention in conformance with the American usage of the term, which includes lightweight elements which are inserted or lightly attached inside a shoe after construction.

May, U.S. Pat. No. 1,710,936, demonstrates a typical insole/midsole in which attention is paid to only one of the three prime aspects of the foot's function, particularly providing support to the arch of the foot. The failure to deal with the rear foot and forefoot regions of the foot causes May to fail in enhancing the total function of the foot. Specifically, May fails to provide forefoot guidance and rear foot cushioning and stability.

Leighton, U.S. Pat. No. 4,541,184, reveals another trend in footwear innersole/midsole, namely, a focus on cushioning. In Leighton, special material properties are utilized to address the concern of cushioning, particularly in the rear foot and forefoot regions. Leighton, however, neglects to provide features that enhance the other two primary functions of the foot, particularly support and guidance. Similarly, Hones, U.S. Pat. No. 4,932,141 focuses on cushioning in the vicinity of the heel, without any attention to the forefoot and midfoot regions.

Freda, U.S. Pat. No. 2,161,565 relates to an apparatus intended to support the midfoot and forefoot. However, the aspects of guidance and cushioning are not addressed in Freda. Further, the mechanism through which support is provided should also act to brace the foot. Any stabilization of the foot should work in unison with the foot's own mechanism for stabilization and should not provide a device which artificially acts as a crutch for the foot. Becker, U.S. Pat. No. 2,383,583, also focuses on the bracing or the stability aspect of the midfoot. However, there is nothing in Becker that provides any form of enhancement for the primary roles of the forefoot and rear foot.

Sarkozi, U.S. Pat. No. 5,138,774 relates to an innersole system to meet personal support requirements of the wearer. The system, however, does not offer any feature that will enhance cushioning or guidance. Similarly, Phillips, U.S. Pat. No. 4,791,736 is directed to a skiboot orthotic but, the focus of the orthotic is on the arch and not on all three areas of the foot and the functions of those areas. Likewise, Marc, U.S. Pat. No. 5,068,983 and Tilles et al., U.S. Pat. No. 5,146,698 are directed to an insole having a heel piece for improved shock absorption, especially for running shoes, without attention to the midfoot and forefoot regions or, the functions of these regions. And, Schroer, Jr. et al., U.S. Pat. No. 5,282,326 concerns a three quarter length insole to provide arch support without a full consideration of all three regions of the foot or, of the functions of these regions.

Thus, it is evident that the prior art has failed to address all of the regions of the foot or, the functions of these regions. Further examples of such documents, as well as examples of art which teaches away from the present invention by providing hard and soft areas different than those of the present invention are discussed below.

Phillipp, U.S. Pat. No. 5,014,706 relates to an orthotic insole having an outline which is said to resemble that of a foot, with portions of the insole corresponding to the calcaneus, first metatarsal head, fifth metatarsal head, those portions having a first, low hardness, the portion corresponding to the lateral longitudinal arch having a second hardness greater than that of the first hardness, the portion corresponding to the area extending back from the metatarsal arch between the lateral and medial longitudinal arches having a third hardness greater than that of the first and second hardnesses. The area of first hardness can be a cavity. In contrast, in the present invention, a region of high pressure is formed about the periphery of the rearfoot and a lower pressure area is created beneath the calcaneus, an area of high pressure beneath the centroid region of the midfoot (the region defined by the navicular, talus and cuboid) and, a high pressure area about the periphery of the forefoot and an area of lower density or compression beneath the apex of the metatarsal or transverse arch by means of an insole device having a cavity and/or a first lower density or softer material in the lower pressure area beneath the calcaneus, in the lower density or compression area beneath the metatarsal or transverse arch and in the area on either side of the centroid region and, a second higher density or harder material in the other areas. The insole of the present invention is a simpler device which attends to the functions of the regions of the foot by having regions of hardness and softness which differ from those of Phillipp.

Likewise, Meyers, U.S. Pat. No. 4,627,177 provides an insole structure wherein the area under the longitudinal arch and a portion of the medial area of the heel are less compressible or more dense than the remainder of the insole, including the area under the metatarsal or transverse arch, contrary to the present invention. Gardner, U.S. Pat. No. 301,226 relates to an innersole with a soft, flexible material beneath the forefoot and midfoot regions and, a hard material beneath the calcaneus, contrary to the present invention.

Edelstein, U.S. Pat. No. 2,909,854 is directed to a pressure relieving insole having an aperture therethrough at a part of the sole bearing a callosity. Edelstein is not concerned with the areas of the foot and their respective functions.

Sullivan, et al., U.S. Pat. Nos. 4,910,886 and 4,694,589 are directed to a shock absorbing insole with low resilience inserts at the heel and at the ball, including to the edges of the ball on each side of the foot, in contrast to the present invention wherein the higher density (harder) material is at the high pressure area about the periphery of the forefoot. Padilla, U.S. Pat. No. 4,955,148 provides a foot support assembly wherein beneath the centroid region there is a recess and, an elevated area in the forefoot and rearfoot regions, directly contrary to the present invention wherein a cavity or recess and/or lower density (softer) material is beneath the calcaneus and the metatarsal or transverse arch and, a harder or higher density material beneath the centroid region.

Glickerson, U.S. Pat. No. 3,233,348 is directed to a laminated insole having flexible top and bottom layers and heel and toe inserts of a stiff or firm material. While the inserts each may have an aperture, contrary to the present invention, the area under the midfoot is formed of relatively soft material (as compared with the inserts). Sawyer, U.S. Pat. No. 492,994 is directed to an inner sole wherein there are openings in the forepart and heelpart with cushioning projecting through the openings, above the upper surface of the marginal portion inner sole at the periphery of the openings (above the dorsal level of the innersole) with a top cover thereover, contrary to the present invention wherein rather than an upwardly projecting cushion, there is a region of softer material and/or a cavity beneath the calcaneus and the metatarsal or transverse arch and, the cavity is on the underside of the innersole. Further, while Sawyer does not limit the number of orifices and upwardly projecting cushions, by identifying the rearfoot and forefoot as places for orifices with upwardly projecting cushions, Sawyer teaches away from the present invention because the present invention includes a relatively hard region or higher density region at the midfoot whereas Sawyer's upwardly projecting rearfoot and forefoot cushions create a void at the midfoot.

Davis, U.S. Pat. No. 4,494,320 and Des. Nos. 267,288 and 267,366 relate to outsoles, not insoles, having a recess at the forefoot and rearfoot. The outsoles of Davis can become filled due to direct contact with the ground and, are not typical outsoles such that shoes therefrom cannot be conventionally resoled. Further, Davis fails to teach or suggest the high and low density materials and regions of the present invention. Additionally, outsoles can have negative impact on the foot; for instance, improper wear of the outsole due to a foot imbalance can only aggravate the problem. Thus, the Davis outsole fails to teach or suggest the present invention or address the issues addressed by the present invention. Famolare, Des. 266,798 is also directed to an outsole, which, while having treads particularly at the forefoot and rearfoot, has a significant heel and, fails to teach or suggest the materials and regions of the present invention.

Mention is also made of: Jalbert et al., U.S. Pat. No. 4,513,518 which relates to an innersole with a layer of polyurethane foam, Shibata, U.S. Pat. No. 5,189,816 which provides a midsole or sole having blades for massaging the sole while walking, Anson, Des. 204,596 directed to an insole having ridges and holes throughout the regions of the foot, Chu, U.S. Pat. No. 5,010,661 which relates to a unidirectional ventilating insole for shoes, Rosen, U.S. Pat. No. 4,931,773 which provides a system for determining the fit of shoes by means of transparent areas in the shoe bottom and, Bradfore, U.S. Pat. No. 363,946 which is directed to a flap connected to the outer surface of the innersole.

Accordingly, it is believed that prior to the present invention an innersole has not been taught or suggested which addresses the three primary functions of the foot (the cushioning, guidance and stability roles of the foot), and which presents features respective to the three primary anatomical regions of the foot, especially by means of two areas of different density.

OBJECTS AND SUMMARY OF THE INVENTION

Objects of the invention include to provide an innersole/midsole unit, to provide a shoe containing such a unit, and, to provide a method, each of which enhances the three primary roles of the foot, by enhancing functions that occur at the three primary foot regions.

The present invention therefore provides an innersole or midsole for use in a shoe or the like and generally having a shoe-shape, said innersole comprising: a first region having a first hardness, said first region designed to underlie the periphery of the rearfoot, the periphery of the forefoot, and the centroid region of the foot; and, a second region having a second hardness, said second region designed to underlie the calcaneal region and the metatarsal or transverse arch, wherein the first region is about 5 to about 15 Shore A durometer harder than the second region.

The first region is preferably a second layer and the second region is preferably a first layer.

The invention further provides an innersole or midsole for use in a shoe or the like comprising:

a) a first generally shoe-shaped layer having a first hardness and, b) a second layer having a second hardness, said second layer designed to underlie the periphery of the forefoot, the periphery of the rearfoot, and the centroid region of the foot and said second layer having means defining a first opening designed to underlie the calcaneal region and means defining a second opening designed to underlie metatarsal or transverse arch, wherein the second hardness is greater than the first hardness and, the second layer is positioned beneath the first layer as a distinct layer beneath the first layer or, said second layer is substantially integral with the first layer.

The invention additionally provides a shoe containing an innersole or midsole of the invention, as well as a method for enhancing functions and performance of a human foot by a user of a shoe comprising installing an innersole or midsole of the invention into the shoe.

These and other objects and embodiments of the invention are provided in, or are obvious from, the following detailed description of the invention.

BRIEF DESCRIPTION OF DRAWINGS

In the following detailed description of the invention, reference will be made to the accompanying drawings, wherein:

FIG. 3A shows a cross-section view of the embodiment of FIG. 2A taken through section A'—A' in the direction of the arrows;

FIG. 4A shows a cross-section view of the embodiment of FIG. 2A taken through section B'—B' in the direction of the arrows;

FIG. 5A shows a cross-section view of the embodiment of FIG. 2A taken through section C'—C' in the direction of the arrows;

FIG. 6A shows a cross-section view of the embodiment of FIG. 2A taken through section D'—D' in the direction of the arrows;

DETAILED DESCRIPTION

Figure 1:
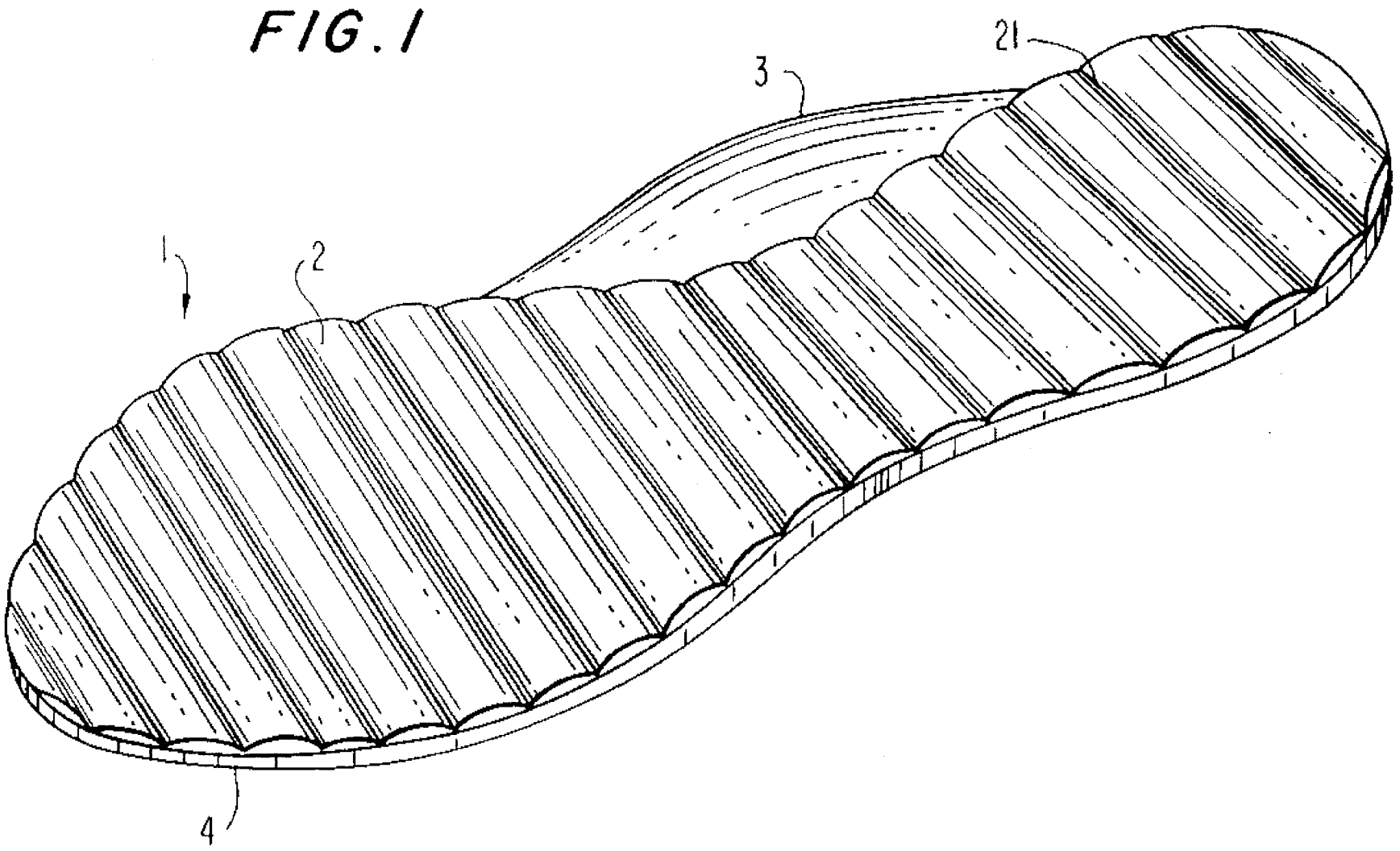
FIG. 1 shows a dorsal perspective view of an embodiment of the invention.
Figure 2:
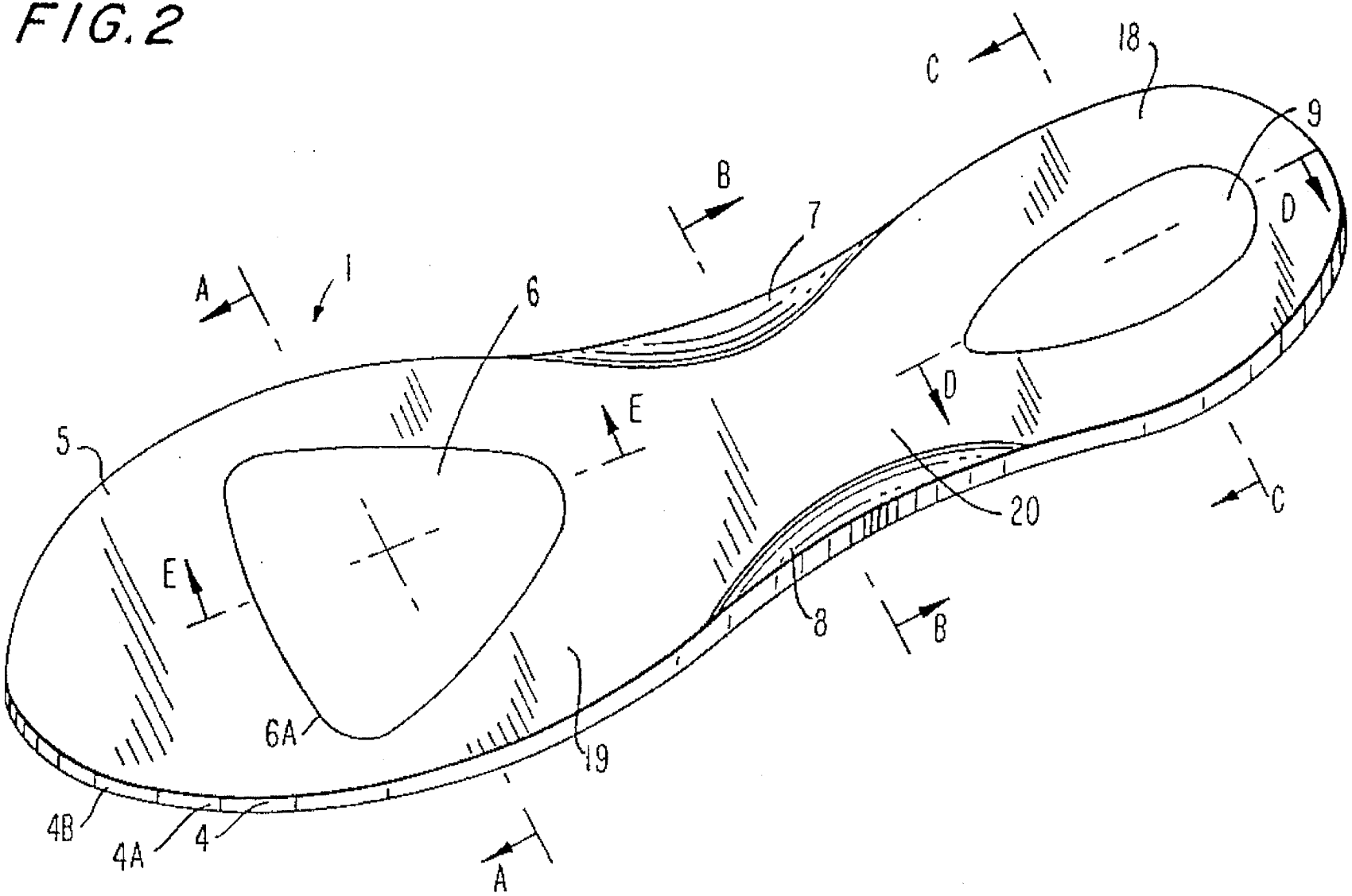
FIG. 2 shows a plantar perspective view thereof.
Figure 2A:
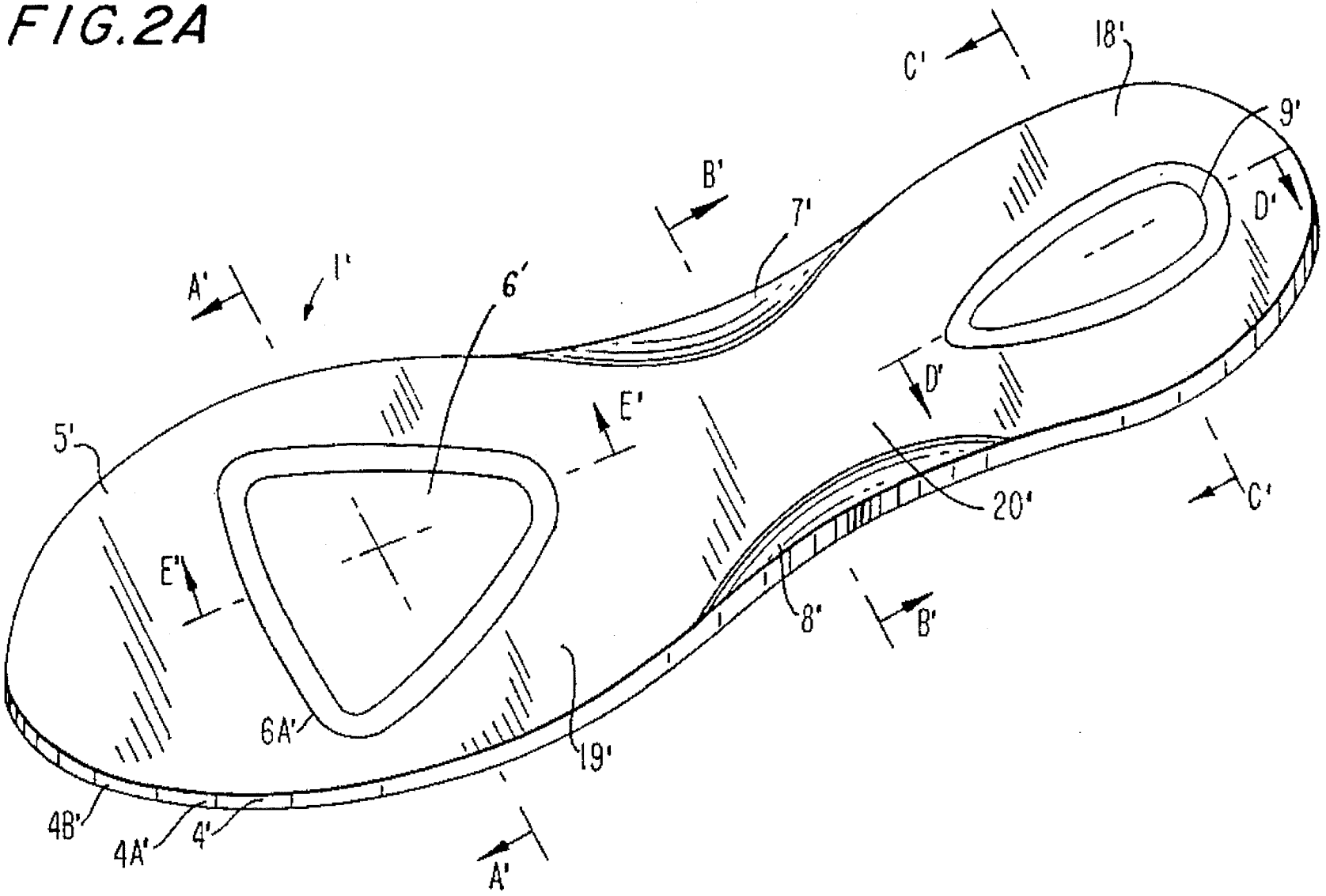
FIG. 2A shows a plantar perspective view of a second embodiment of the invention.
Figure 3:
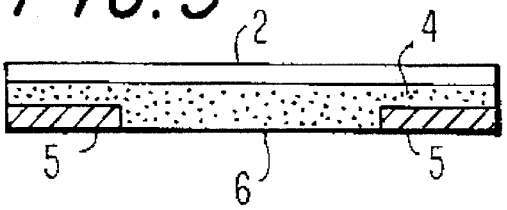
FIG. 3 shows a cross-section view of the embodiment of FIG. 2 taken through section A—A in the direction of the arrows.
Figure 4:
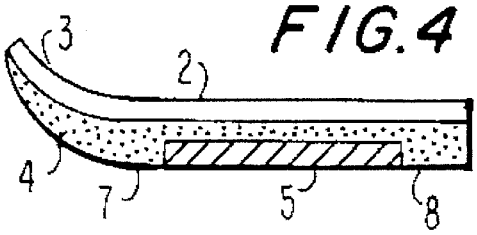
FIG. 4 shows a cross-section view of the embodiment of FIG. 2 taken through section B—B in the direction of the arrows.
Figure 5:
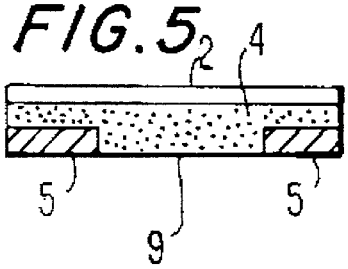
FIG. 5 shows a cross-section view of the embodiment of FIG. 2 taken through section C—C in the direction of the arrows.
Figure 6:
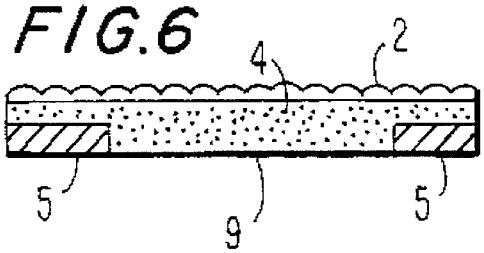
FIG. 6 shows a cross-section view of the embodiment of FIG. 2 taken through section D—D in the direction of the arrows.
Figure 7:
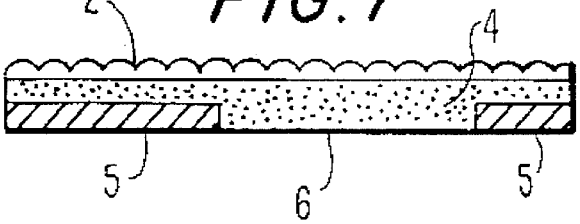
FIG. 7 shows a cross-section view of the embodiment of FIG. 2 taken through section E—E in the direction of the arrows; and, FIG. 7A shows a cross-section view of the embodiment of FIG. 2A taken through section E'—E' in the direction of the arrows; and, FIG. 8 shows a dorsal view of an the insole of the invention, indicated by the dashed lines, and its relationship to the foot when both interface in a preferred manner.

The present invention provides a shoe innersole or midsole device made from materials of multiple densities such as multi-cellular materials. Preferably there are three distinct regions of the innersole/midsole device of the invention. The first region is alignable with the rearfoot. The second region is alignable with the midfoot. The third region is alignable with the forefoot region.

The innersole/midsole has a region of high pressure (high density or relatively hard material) about the periphery of the rearfoot, such that a lower pressure area (lower density or relatively softer material) is created beneath the center of mass of the calcaneus to provide a bi- or multi-density effect. Thus, cushioning at a key impact area and support about the periphery of the rearfoot are provided. The configuration of this low density area should preferably simulate the geometry of the calcaneus and should therefore preferably be substantially circular or substantially oval or substantially elliptical.

The innersole or midsole of the invention also has an area of high pressure beneath the centroid region of the midfoot, namely the region defined by the navicular, talus and cuboid. The invention thus provides multi-directional stability about the center of mass of the foot, and stability through which the center of mass of the body acts during ambulation. The presence of a higher density or a relatively hard material in the centroid region provides stability to the three key bones of the centroid region, namely the talus, navicular, and the cuboid, which thereby enhances the stability of the foot and the ability of the foot to provide a proper structural precursor for ideal guidance during propulsion.

The innersole or midsole of the invention additionally has a high pressure area (high density or relatively hard material) about the periphery of the forefoot to provide lateral and medial stability to the outermost rays of the foot as well as to introduce a bi- or multi-density effect in the forefoot region, i.e., to provide an area of lower density or compression (lower density or relatively softer material) beneath the apex of the metatarsal or transverse arch to accommodate natural arch deflection. The combination of high pressure area about the periphery of the forefoot and the area of lower density beneath the metatarsal or transverse arch provides stability and cushioning in the forefoot region which further provides structural integrity of the metatarsal arch to allow for guidance of the foot during the propulsion phase of gait. The shape of the low density zone in the forefoot region may be any suitable shape which provides stabilization for the base of the first and fifth rays and, which accommodates for deflection of the apex of the transverse arch. The shape of the low density zone in the forefoot may therefore be substantially circular, substantially oval, substantially triangular, substantially elliptical, substantially quadrilateral, or any other suitable polygon.

Thus, by the present invention addressing the three main regions of the foot, the total foot is provided with a stable base of multi-directional support and the ability to accommodate impact loading and natural arch deflection. By the present invention the rearfoot is capable of providing its primary function of cushioning and its secondary function of stability. By the present invention the mid-foot is able to provide its primary functions of stability and guidance and, is also able to provide the medial longitudinal arch with natural deflection capability ties for enhanced cushioning. Further, by the present invention, the forefoot region is provided with a mechanism to enhance its primary role of guidance for propulsion, as well as its secondary roles of cushioning and stability.

Any suitable materials may be used in the fabrication of the insole/midsole of the invention. The presently preferred and most cost effective materials for the fabrication of the insole/midsole of the invention are polyurethanes and ethyl vinyl acetates (EVA). In this regard it is noted that the entire insole/midsole can be fabricated from either polyurethane or EVA. The skilled artisan from this disclosure and the knowledge in the art can fabricate polyurethanes of different density or hardness; for instance, by varying the air, gas or blowing agent. Likewise, from this disclosure and the knowledge in the art, EVAs of different density or hardness can be fabricated; for instance, by varying the amount of monomeric units (e.g., ethylene or vinyl acetate). Other materials such as polyethylenes, foam rubbers or other foam plastics or elastomers can be used and, fabricating or obtaining such materials in different densities is within the ambit of the skilled artisan. When selecting a material for an insole/midsole, one may wish to consider providing the end consumer with an insole/midsole having favorable durability and longevity characteristics (i.e., relatively durable and long-lasting).

The regions of the insole/midsole of invention that are of a high density or relatively hard material should preferably have a hardness which is about 5 to about 15 Shore A durometer greater than the low density or relatively softer material. The insole/midsole of the invention may also be fitted with a top cover layer to provide an intermediary contact zone between the foot and the main body of the insole/midsole of the invention. This top cover may be of any suitable material for a top cover, such as felt or imitation felt. Other materials presently employed as a top cover of an insole in the footwear art may also be used for the top cover of the insole/midsole of the invention. The top cover can also be designed to incorporate special ventilation features, shock absorption features, anti-bacterial features, antifungal features, or the like.

The invention can be manufactured in any suitable manner. The regions of varying density can be adhesively laminated to each other, and, if desired, the top cover laminated thereover. The regions of varying density may be die cut from the suitable materials (discussed above), and adhered together using standard adhesives and adhering means. Another method for manufacturing the insole/midsole is molding such as by multi-density injection molding. The material for the insole/midsole in this method is preferably polyurethane or liquified EVA. By these manufacturing methods, the second, relatively harder layer may be disposed over the underside of the first relatively softer layer; or, the second layer may be imbedded into the first layer. If the invention is to be used as a midsole unit for an article of footwear, the application of a rubber wearing layer is preferred so as to provide additional durability and longevity.

Figure 8:
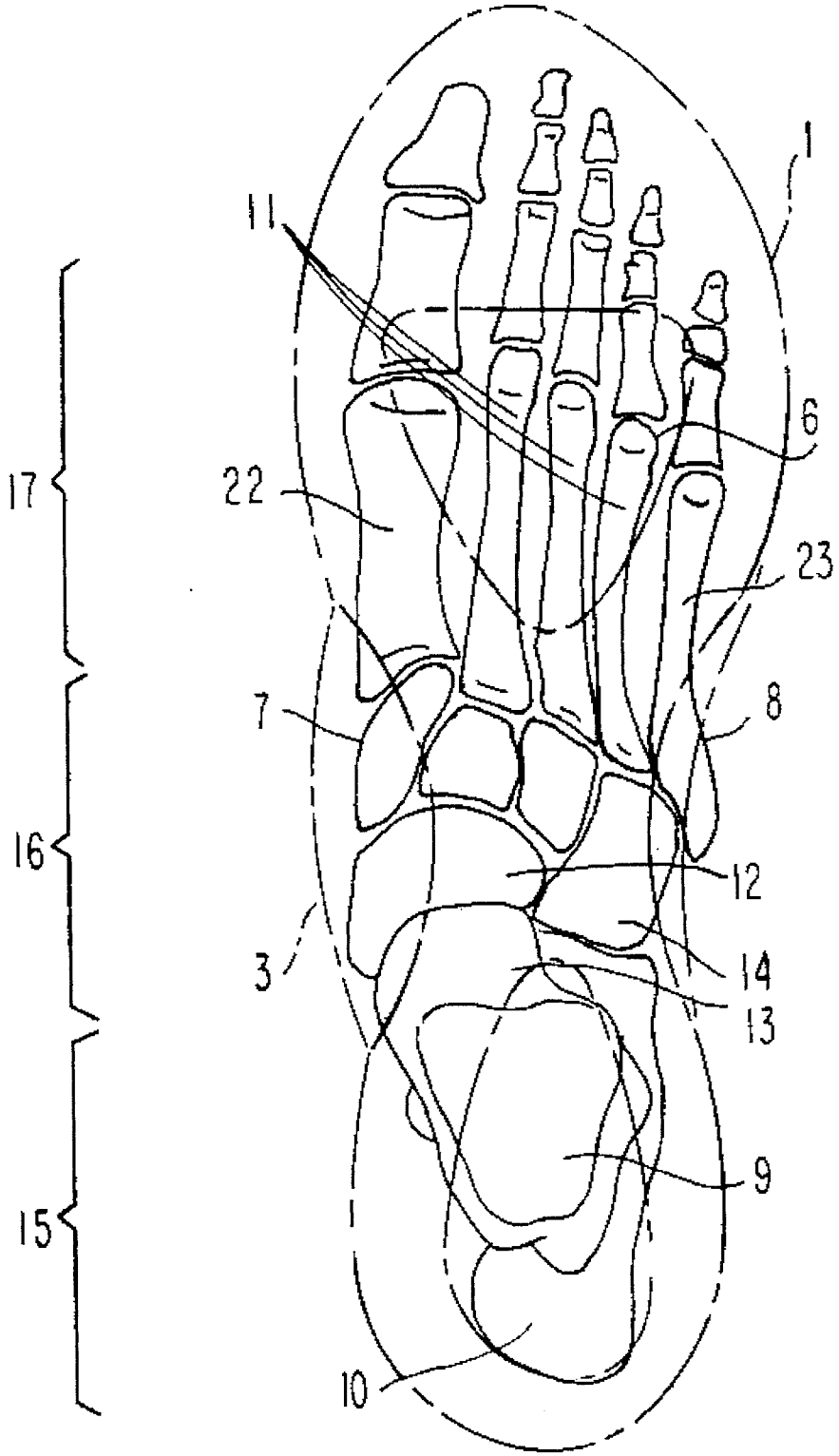

Turning now to the Figures, it is to be noted that FIGS. 1 and 8 are relevant to all embodiments of the invention, that FIGS. 2 to 7 illustrate a first embodiment and, that FIGS. 2A to 7A illustrate a second embodiment. Similar components in FIGS. 1 to 8 and 2A to 7A are similarly numbered (or lettered), with the latter set of Figures (i.e., 2A to 7A) employing a prime next to the number (or letter) which is similar in the former set of Figures (i.e., 1 to 8). Variations on these embodiments (further embodiments) are also shown in the Figures and, discussed in more detail below. Further, it is to be noted that "insole" or "innersole" includes "midsole".

FIGS. 1, 2, 2A and 8 show a dorsal perspective, plantar perspective and dorsal views of insole embodiments of the invention. The insole 1 and 1' is generally foot or shoe shaped. As depicted in FIG. 1, a view looking downward on the top of insole 1, insole 1 preferably has as a top or uppermost layer, top cover 2.

Top cover 2 (or 2'), as shown, has a corrugated top surface with air channels or corrugations 21 which run perpendicular to the long axis of insole 1 (or 1'). Air channels 21 are provided for ventilation, energy return, shock absorption and anti-bacterial and anti-fungal features. 0f course, top cover 2 (or 2') need not be provided and, if provided, need not have air channels 21. If provided, top cover 2 (or 2') can also have a flat or any other suitable top surface.

As shown in FIG. 1, the insole of the invention preferably includes arch support 3. The insole of the invention need not include arch support 3; but, if included (as is preferred), it is further preferred that arch support 3 be inclusive of (formed from) lower density layer 4 or 4'. However, if desired for those in need of such support, arch support 3 can be formed from higher density layer 5 or 5' or both layers 4 (or 4') and 5 (or 5'). Arch support 3 can provide increased support for the arch and, may be considered as a medial-most extension in the area of the medial, longitudinal arch. Additionally, if top cover 2 is provided, it is preferred that top cover 2 also cover arch support 3 (if arch support 3 is also provided).

Referring now particularly to FIGS. 2 to 7, 2A to 7A, and 8, insole 1 or 1' in its simplest embodiment, is comprised of first layer 4 or 4' and, second layer 5 or 5'. First layer 4 or 4' is formed from a lower density or relatively softer material. First layer 4 or 4' is a top layer of insole 1 or 1' (underneath top cover 2, if provided) and, is preferably one-piece. First layer 4 or 4' is generally foot or shoe-shaped (see also FIG. 1) in this embodiment. Second layer 5 or 5' is from a higher density or relatively harder material. Second layer 5 or 5' is a bottom layer of insole 1 or 1' beneath layer 4 or 4' Second layer 5 or 5' preferably is one-piece. Second layer 5 or 5' is located around the periphery 18 of the rearfoot 15, continues forward beneath the centroid region 20 and, further continues forward around the periphery 19 of the forefoot 17 such that in second layer 5 or 5' there is cut-out 9 is beneath the calcaneus 10 (the calcaneal region) and cut-out 6 beneath the apex of the metatarsal or transverse arch. Preferably, second layer 5 or 5' narrows in the area beneath the centroid region 20 such that on the arch side 7 and the outer side 8 of the centroid region 20 there is a low density region, so long as a sufficient high density region is maintained in the midfoot region 16. Of course, high density second layer 5 or 5' can, at the midfoot region 16, extend the full width of the insole 1 or 1' on either or both of sides 7 and 8.

Thus, in this embodiment, low density or softer material is employed in the area of first layer 4 or 4' which is forward lines 4A, 4A', 6A and 6A', i.e. in area 4B and 4B' of first layer 4 and 4'. Lines 4A and 4A' 6A and 6A' correspond to the forward most line of cut-out 6 or 6', which as shown, is generally triangular with a rounded point towards the rearfoot and a forwardmost side thereof generally perpendicular to the shafts or rays 11 of the foot or to the long axis of insole 1 or 1'.

Alternatively, in another embodiment, first layer 4 or 4' can be formed of two materials: high density or relatively harder material in area 4B or 4B' (forward lines 4A, 4A', 6A and 6A').

FIGS. 2 to 7 and 2A to 7A each show an embodiment of the invention. In FIGS. 2 to 7 more dense second layer 5 is embedded into (or is integral with) less dense or softer layer 4 such that on the bottom or under side of insole 1, layers 4 and 5 are substantially coplanar. For instance, the less dense or softer first layer 4 extends through cut-outs 6 and 9 and around the sides 7 and 8 of centroid region 20 so as to be substantially coplanar with the more dense or harder second layer 5 at cut-outs 6 and 9 and sides 7 and 8 surrounding centroid region 20. In FIGS. 2A to 7A, the more dense or harder second layer 5' is positioned over (as opposed to in or integral with) softer, less dense layer 4'. Thus, layer 5' is raised over layer 4' especially at cut-outs 4' and 9' and at regions 7' and 8' which are not covered by layer 5' and are thus beneath the plane defined by the surface of layer 5'.

In the embodiments of the Figures, layers 4 or 4' should be 5 to 15 Shore A lower than the durometer reading of higher density layer 5 or 5'. Additional layers, such as top cover 2 or a bottom cover (not shown) or layers between layers 4' and 5' may also be employed.

The interfacing of the low density layer 4 or 4' and the high density layer 5 or 5' creates three noticeable areas of distinction. These distinctive areas are alignable with the rearfoot 15, midfoot 16, and forefoot 17 regions of the human foot. Innersole/midsole 1 or 1' forms a region of high pressure about the periphery 18 of the rearfoot 15, from second layer 5 or 5' being located around the rearfoot periphery 18. A lower pressure area is created at cut-out 9 and 9' beneath the center of mass of the calcaneus 10 (by the omission thereat of second layer 5 or 5'). Accordingly, at the rearfoot 15, the invention provides a bi-or multi-density affect: cushioning at the key impact area cut-out 9 and 9' and support about the periphery 18 of the rearfoot 15.

The shape of cut-out 9 or 9' preferably simulates the geometry of the calcaneus 10 and, therefore is preferably circular, or oval or elliptical in nature.

The insole of the invention also provides for an area of high pressure beneath the centroid region 20 of the mid-foot 16, namely the region defined by the navicular 12, talus 13 and cuboid 14 bones of the foot, by the presence thereunder of high density or harder material layer 5 or 5'. The insole of the invention thus provides multidirectional stability about the foot's center of mass, and stability through the region of the foot through which the body's center of mass acts during ambulation. The presence of a higher density material in this location ensures stability of three key bones of the centroid region (the talus 13, navicular 12, and the cuboid 14). This helps enhance the stability of the foot and its ability to provide a proper structural precursor for guidance during propulsion.

The insole of the invention also provides a high pressure area about the periphery 19 of the forefoot 17 to provide lateral and medial stability to the outermost rays (22, 23) of the foot. Bi- or multi-density effect in the forefoot region 17 is provided by cut-out 6 and 6' in the layer 5 or 5' which exposes lower density layer 4 or 4' and provides a compression set beneath the apex of the metatarsal or transverse arch 11 to accommodate natural arch deflection. This provides stability and cushioning accommodation to assist in natural forefoot cushioning that is not limited and, importantly assists in the structural integrity of the metatarsal arch 11 to allow for guidance of the foot during the propulsion phase of gait. The shape of cut-out 6 or 6' may vary and be any suitable shape which provides stabilization for the base of the first 22 and fifth 23 rays, and for accommodation of the apex of the transverse arch 11 is accommodated for deflection. For instance, the shape can be circular, oval triangular, elliptical, quadrilateral, or any other polygon form.

Thus, by addressing the three main regions of the foot, the total foot is provided with a stable base of multidirectional support and the ability to accommodate impact loading and natural arch deflection. In this manner, the rearfoot 15 is capable of providing the primary functions of cushioning and the secondary function of stability. By the insole of the invention, the midfoot 16 is able to provide stability and guidance which are primary functions of the midfoot and, the invention is also able to provide the medial longitudinal arch 24 with deflection capabilities for enhanced cushioning. The forefoot 17 of the foot is provided by the insole of the invention with a mechanism to enhance the primary roles of cushioning and forefoot stability. And, top cover 2 is preferably present as it provides an intermediary contact between the foot and the remainder of the insole, especially as shown, because additional comfort and other features are provided by top cover 2. Accordingly, when installed into a shoe, the functions and performance of the foot of the user of the shoe are enhanced when the shoe is worn. Thus, the invention comprehends methods and shoes employing the inventive insole.

Having thus described in detail preferred embodiments of the present invention, it is to be understood that the invention defined by the appended claims is not to be limited by particular details set forth in the above description, as many apparent variations thereof are possible without departing from the spirit or scope of the present invention.

What is claimed is:

1. An innersole for underlying a human foot, said human foot having a forefoot, a rearfoot, a centroid region, a calcaneal region, and a metatarsal arch, said innersole comprising:

a) a first layer having a first hardness and a shape corresponding to the full plantar sole of the human foot, and a lowermost portion of the first layer lying in a first plane b) a second layer having a second hardness, said second layer for underlying the periphery of the forefoot, the periphery of the rearfoot, and the centroid region of the foot and said second layer having means defining a first opening for underlying the calcaneal region and means defining a second opening for underlying the metatarsal arch, and a uppermost portion of the second layer lying in a second plane wherein the second hardness is greater than the first hardness and, the second layer is positioned beneath and is distinct from the first layer and the first and second planes being directly adjacent.

2. The innersole of claim 1 including a top cover positioned over the first layer.

3. The innersole of claim 2 wherein at least one of the first and second layers includes a medial-most extension designed to underlie the medial longitudinal arch.

4. The innersole of claim 1 wherein the second layer is about 5 to about 15 Shore A by durometer harder than the first layer.

5. The innersole of claim 1 wherein each of the layers are made from polyurethane or ethylene vinyl acetate.

6. The innersole of claim 1 wherein the first opening is substantially circular.

7. The innersole of claim 1 wherein the first opening is substantially elliptical.

8. The innersole of claim 1 wherein the second opening is substantially triangular.

9. The innersole of claim 1 wherein the second opening is substantially circular.

10. The innersole of claim 1 wherein the second opening is substantially elliptical.

11. A shoe containing the innersole of claim 1.

* * * * *